US008018339B2

(12) United States Patent
Morita et al.

(10) Patent No.: US 8,018,339 B2
(45) Date of Patent: Sep. 13, 2011

(54) INTRUDER DETECTION SYSTEM

(75) Inventors: Keisuke Morita, Tokyo (JP); Yoshio Sato, Tokyo (JP); Sayu Takamatsu, Tokyo (JP); Kenji Inomata, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 430 days.

(21) Appl. No.: 12/236,891

(22) Filed: Sep. 24, 2008

(65) Prior Publication Data

US 2009/0251317 A1 Oct. 8, 2009

(30) Foreign Application Priority Data

Apr. 8, 2008 (JP) ..... 2008-100443

(51) Int. Cl.
*G08B 13/18* (2006.01)

(52) U.S. Cl. ..... 340/552; 333/237

(58) Field of Classification Search ..... 340/552–554; 333/237

See application file for complete search history.

(56) References Cited

U.S. PATENT DOCUMENTS

| | | | | |
|---|---|---|---|---|
| 4,091,367 | A * | 5/1978 | Harman | 340/552 |
| 4,415,885 | A * | 11/1983 | Mongeon | 340/552 |
| 4,879,544 | A * | 11/1989 | Maki et al. | 340/552 |

FOREIGN PATENT DOCUMENTS

| | | | |
|---|---|---|---|
| JP | 5-143877 | A | 6/1993 |
| JP | 06-222153 | | 8/1994 |
| JP | 7-160962 | A | 6/1995 |
| JP | 9-292460 | A | 11/1997 |
| JP | 2007-179402 | A | 7/2007 |

OTHER PUBLICATIONS

Office Action issued in the corresponding Japanese Patent Application No. 2008-100443 dated Apr. 27, 2010. (2 pages, not in English).

* cited by examiner

*Primary Examiner* — Thomas Mullen
(74) *Attorney, Agent, or Firm* — Buchanan Ingersoll & Rooney PC

(57) ABSTRACT

An intruder detection system is provided in which a detection range can be set to a predetermined one so that false detection caused by a moving object outside the predetermined range can be diminished. The system includes a transmission-side leaky transmission line that radiates a detection signal for detecting an intruder and a reception-side leaky transmission line that receives a detection signal leaked from the transmission-side leaky transmission line, both of which are buried spaced apart from each other in a detection surveillance area, and detects the presence/absence of an intruder in the detection surveillance area based on variations in the detection signal received by the reception-side leaky transmission line, wherein at least part of either the transmission-side leaky transmission line or the reception-side leaky transmission line is made of a surface-wave-type leaky coaxial transmission line, and the other leaky transmission line, a radiation-type leaky coaxial transmission line.

6 Claims, 8 Drawing Sheets

521

| X1 | Y1 | X2 | Y2 | X3 |
|---|---|---|---|---|
| DETECTION | NON-DETECTION | DETECTION | NON-DETECTION | DETECTION |

INTRUDER DETECTION SYSTEM

BACKGROUND OF THE INVENTION

1. Field of the Invention

The present invention relates to intruder detection systems that detect, by burying in intruder surveillance areas leaky transmission lines, whether or not intruders such as humans are present in those areas.

2. Description of the Related Art

As shown in Japanese Laid-Open Patent Publication No. 2007-179402, a conventional intruder detection system is configured as follows: A radiation-type leaky coaxial transmission line is used for leaky transmission lines each on the transmission side and the reception side, a detection signal leaked from the transmission-side leaky transmission line is received by the reception-side leaky transmission line, and an intruder is detected based on variations in the signal level of the received detection signal caused by the intruder. The radiation-type leaky coaxial transmission line is the one that uses a leaky coaxial transmission cable that propagates a radio wave in leaky wave mode, and radiates a large quantity of detection signal in a transverse direction of the transmission line (direction outward from the leaky transmission line and perpendicular to a longitudinal direction thereof).

Despite the above, because the intruder detection system observes scattering of the detection signal by an object, if a large quantity of detection signal is radiated in the transverse direction of the transmission line, scattering of the detection signal by an object moving in the transverse direction of the transmission line is enhanced. Thereby, although a detection range is required to be set to a predetermined intruder surveillance area, an actual surveillance area may sometimes become greater than the predetermined area. Therefore, there has been a problem in that, when the size of an object is extremely large, an object outside a detection area might be unnecessarily detected even if it is distant from the transmission line.

By the way, a surface-wave-type leaky coaxial transmission line is well known that generates a surface electric field in the close proximity of the transmission line (a transmission line using a leaky coaxial transmission cable that propagates a radio wave in surface wave mode); however, using of this surface-wave-type leaky coaxial transmission line has caused a problem in that the detection area becomes too small because the detection signal reaches only the close proximity of the transmission line, as well as detectable height from the transmission line thereby becomes lower compared to the predetermined intruder surveillance area.

As described above, there have been problems in that a distant unnecessary object is detected in the intruder detection system when a radiation-type leaky coaxial transmission line is used, while a detection area becomes too small in the intruder detection system when a surface-wave-type leaky coaxial transmission line is used.

SUMMARY OF THE INVENTION

The present invention, coping with the above-described problems, aims at providing an intruder detection system in which its detection range can be set to a predetermined detection range and false detection caused by a moving object outside the predetermined detection range can be diminished.

According to the present invention, in an intruder detection system in which a transmission-side leaky transmission line that transmits a detection signal and a reception-side transmission line that receives the detection signal transmitted from the leaky transmission-side transmission line are buried in an intruder surveillance area, and whether or not an intruder is present in the intruder surveillance area is determined based on variations in the detection signal received by the reception-side leaky transmission line, at least part of either the transmission-side leaky transmission line or the reception-side leaky transmission line is made of a surface-wave-type leaky coaxial transmission line and the other leaky transmission line, a radiation-type leaky coaxial transmission line.

According to the intruder detection system of the present invention, a transverse detection range can be limited while keeping a height-wise detection range unchanged, so that false detection of a moving object outside the predetermined detection range can be diminished.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

First of all, an outline of a basic intruder detection system of the present invention will be explained referring to FIGS. 1 through 6.

Figure 1:
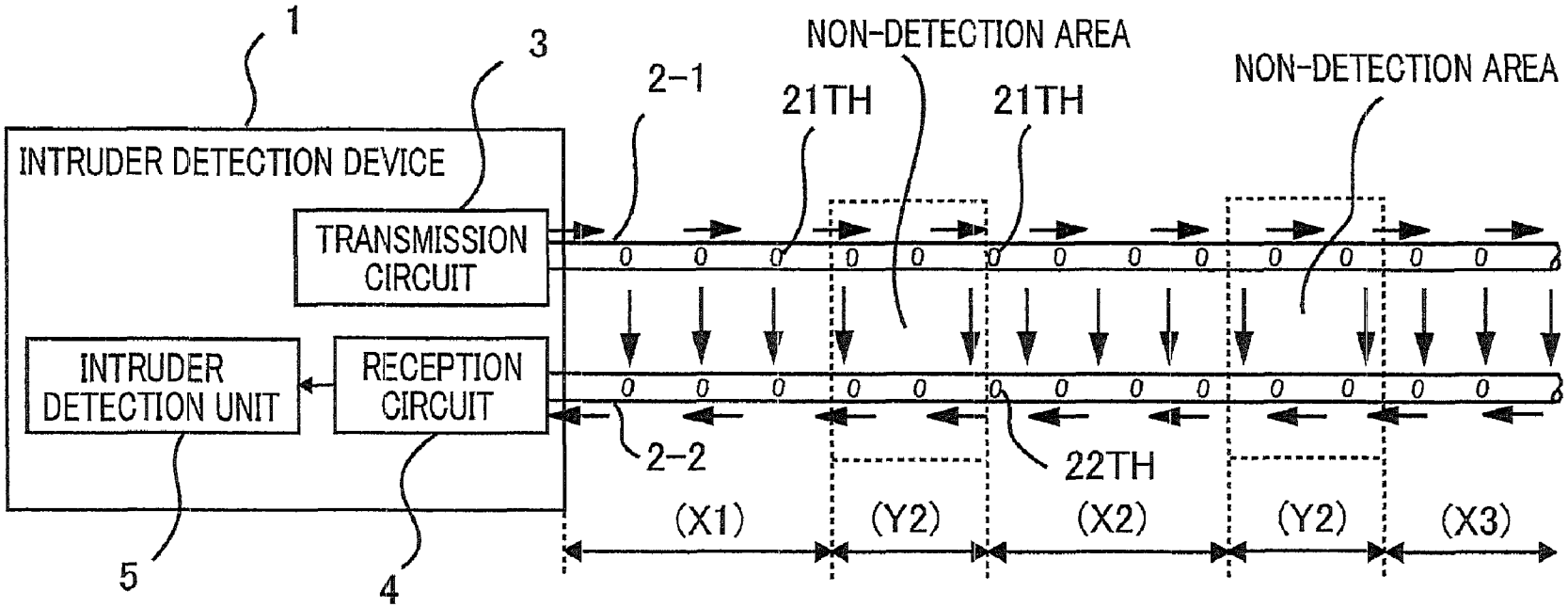
FIG. 1 is a view illustrating a basic configuration of an intruder detection system according to the present invention.

FIG. 1 is a view illustrating a basic configuration of the intruder detection system, which includes an intruder detection device 1, and a transmission-side leaky transmission line 2-1 and a reception-side leaky transmission line 2-2 that are connected to the device 1 and buried side by side in an intruder surveillance area. The intruder detection device 1 includes a transmission circuit 3, a reception circuit 4 and an intruder detection unit 5. Commercially available leaky coaxial cables, for example, are used for the transmission-side leaky transmission line 2-1 and the reception-side leaky transmission line 2-2. Leaky points 21TH of the transmission-side leaky transmission line 2-1 and leaky points 22TH of the reception-side leaky transmission line 2-2, when commercial leaky coaxial cables are used therefor, are through-slots that are provided therein at intervals of every several meters and pierce their cable sheaths.

A detection signal is transmitted from the transmission circuit 3 of the intruder detection device 1 to the transmission-side leaky transmission line 2-1, radiated from the leaky points 21TH, and then received by the reception-side leaky transmission line 2-2. If the detection signal received by the reception-side leaky transmission line 2-2 varies, the intruder detection unit 5 determines that an intruder such as a person is present there.

Figure 2:
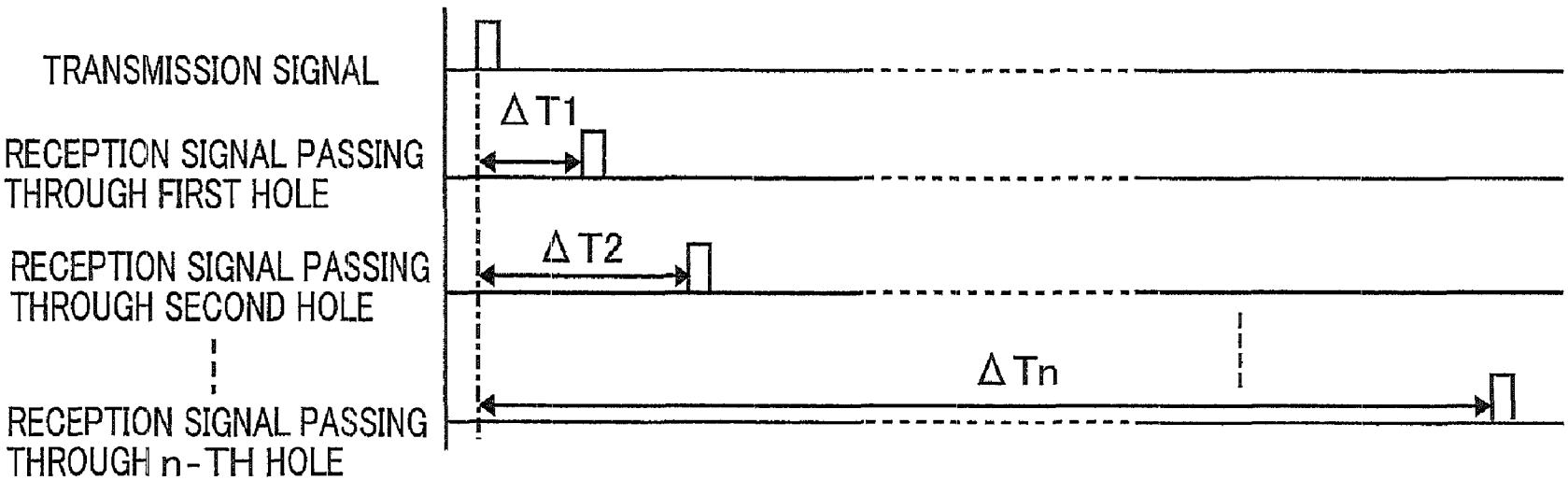
FIG. 2 is a view for explaining the concept of detecting an intrusion location in the intruder detection system in FIG. 1.

Here, an example of a basic method of detecting an intruder will be explained using FIG. 2.

Commercial coaxial cables are used as the transmission-side leaky transmission line 2-1 and the reception-side leaky transmission line 2-2; the transmission-side leaky transmission line 2-1 and the reception-side leaky transmission line 2-2 are buried spaced several meters apart from each other. When a transmission pulse, for example, is transmitted from the transmission circuit 3 as shown in FIG. 2, a radio wave leaked from a first hole (through-slot) of the transmission-side leaky transmission line 2-1 is received through a first hole (through-slot) of the reception-side leaky transmission line 2-2, and then reaches the reception circuit 4 as a reception signal, arrival time of which is $\Delta T1$ after it has been transmitted.

Similarly, when a transmission pulse is transmitted from the transmission circuit 3, a radio wave leaked from a second hole (through-slot) of the transmission-side leaky transmission line 2-1 is received through a second hole (through-slot) of the reception-side leaky transmission line 2-2, and then reaches the reception circuit 4 as a reception signal, arrival time of which is $\Delta T2$ after it has been transmitted.

Similarly, arrival time of a reception signal through a third hole is $\Delta T3$ after it has been transmitted.

Those $\Delta T1$, $\Delta T2$, $\Delta T3$, . . . , that is, arrival time $\Delta T$, if the length of the transmission line is known, can be easily calculated using the signal propagation speed of $3.0\times10^5$ kilometers/second (in the air).

Therefore, storing of data relating to the arrival time $\Delta T$ calculated in advance based on the system configuration enables the reception circuit 4 to discriminate, by matching an actual reception signal with its corresponding storage data, which hole (through-slot) the signal has passed through.

Moreover, when a person intrudes into an area where a leaked radio wave exists, the leaked radio wave varies in its waveform or the like.

Therefore, detecting by the intruder detection unit 5 of variations in the signal received by the reception circuit 4 allows the system to detect which location along the transmission-side leaky transmission line 2-1 and the reception-side leaky transmission line 2-2 the intruder has intruded into, so as to report the result.

Figure 3:
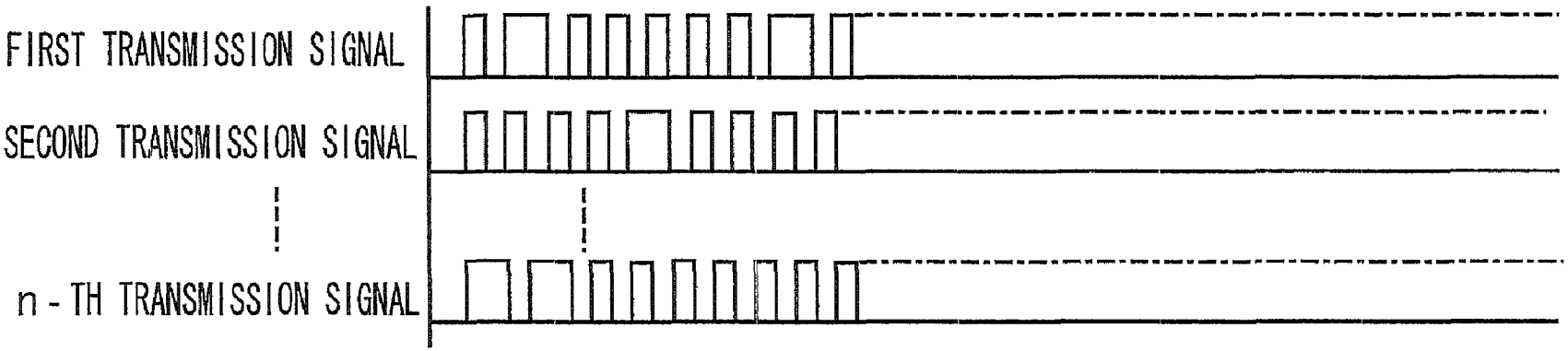
FIG. 3 is a view illustrating an example of a transmission signal in the intruder detection system in FIG. 1.

Actually, a single pulse is not transmitted once every few seconds as the transmission signal, but instead a pseudo spreading code, so-called PN code exemplified in FIG. 3, is used, which includes pulse trains of, for example, several tens of thousands of pulses; thereby, detection accuracy can be enhanced. The identical PN codes may be repeatedly transmitted, or different PN codes may be transmitted one by one as a first transmission signal, a second transmission signal and a third transmission signal as illustrated in FIG. 3. The PN code itself is a code generally known in the public domain.

When PN codes are used in the intruder detection system illustrated in FIG. 1, the intruder detection device 1 phase-modulates a high frequency carrier wave with an output signal from the transmission circuit 3 that generates spreading codes so as to output the phase-modulated carrier wave into the transmission-side leaky transmission line 2-1. A radio wave radiated from the transmission-side leaky transmission line 2-1 is received by the reception-side leaky transmission line 2-2, and then transmitted to the intruder detection unit 5 through the reception circuit 4. In the intruder detection unit 5, the received radio wave is phase-computed with a reference spreading code associated with an intrusion distance (which is referred to as reverse spreading), and then an intruder corresponding to its intrusion distance is detected from variations in the electric field strength of the received radio wave obtained as a calculation result.

According to studies conducted by the inventor and others, when the intruder detection system described above is employed, it has been found that, by burying the leaky transmission line 2-1 and the leaky transmission line 2-2 both of which are some 600 meters long, the presence/absence of an intruder and its intrusion location along the leaky transmission line 2-1 and 2-2 can be detected over a distance of some 600 meters. Capability of detecting the presence/absence of an intruder and its intrusion location over such a distance as long as 600 meters allows this system to be applied to general factories, substations, airports, parking facilities and the like.

And now, if detection can be performed over such a distance as long as 600 meters, there may be cases in which gates, public roads or the like exist within the intruder surveillance area because of such a long distance as 600 meters. It becomes necessary in those cases to also devise a way on the system to set up non-detection areas so as to prevent people passing through those gates or public roads from being identified as intruders. The leaked radio wave is disturbed by, for example, people passing through gates or public roads, resulting in variations in the received signal; processing also needs to be performed on the reception side so that those people are not identified as intruders regardless of the signal variations.

Therefore, an intruder detection system of this kind is configured as follows: Besides an intrusion-location-detection function unit 51 that detects an intruder's intrusion location by the state of each of received signals by the reception circuit 4, a storage unit 52 that stores a detection table 521 enabling a non-detection area to be set up is provided as shown in FIG. 4 in the intruder detection unit 5 of the intruder detection device 1; information on an intrusion location detected by the intrusion-location-detection function unit 51 is matched by a CPU 53 with information set in the detection table 521; and if information on the intrusion location detected by the intrusion-location-detection function unit 51 relates to non-detection area set in the detection table 521, a detection result output unit 54 outputs no detection result.

Figures 4, 5:
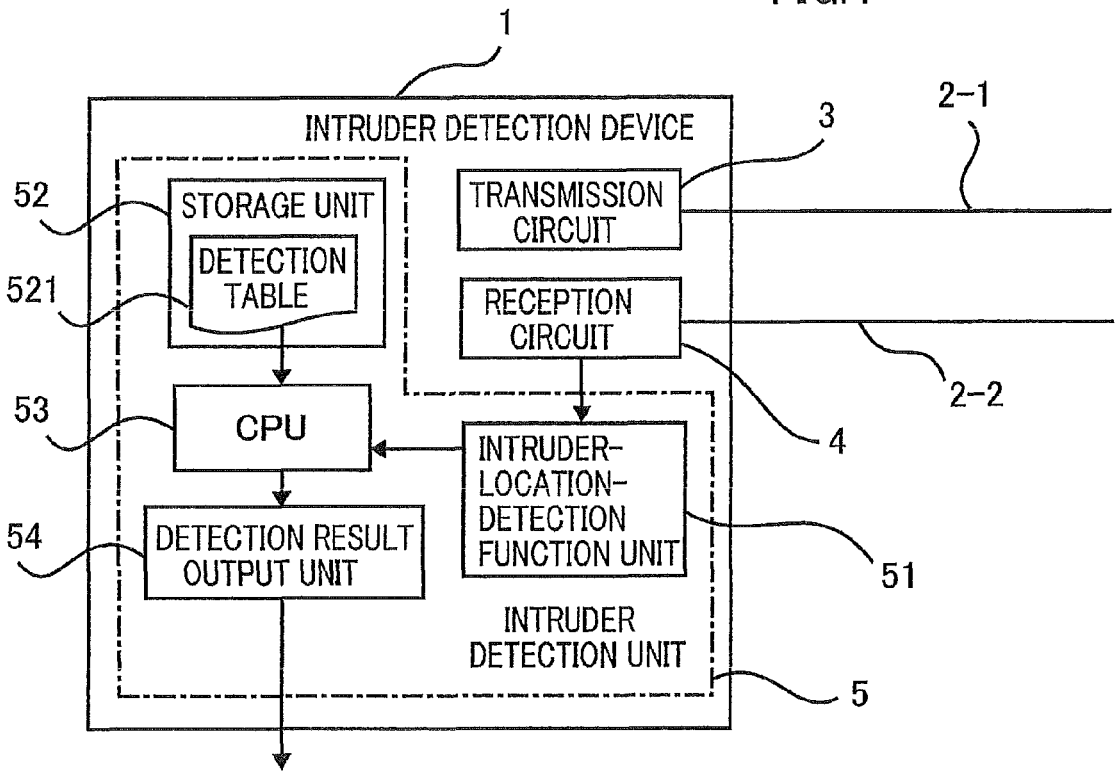
FIG. 4 is a block diagram illustrating an interior configuration of an intruder detection device in FIG. 1.
FIG. 5 is a view showing an example of a detection table in the intruder detection device in FIG. 1.

FIG. 5 is a view showing an example of the detection table 521 in the intruder detection device 1.

In FIG. 5 and above-described FIG. 1, X1, X2, X3 are ranges (locations) in which intruders need to be detected and Y1 and Y2, ranges (locations) in which intruders do not need to be detected. The detection table 521 exemplified in FIG. 5 is the one that associates detectable intrusion locations X1, X2, X3, Y1 and Y2 each with a detection area or a non-detection area. If information on an intrusion location detected by the intrusion-location-detection function unit 51 falls under a detection area in the detection table 521, the detection result output unit 54 outputs a detection result, while if the information falls under a non-detection area in the detection table 521, the detection result output unit 54 outputs no detection result.

The operation of the intruder detection device 1 will be explained next using the flowchart shown in FIG. 6, referring to FIG. 1 and FIG. 4.

Figure 6:
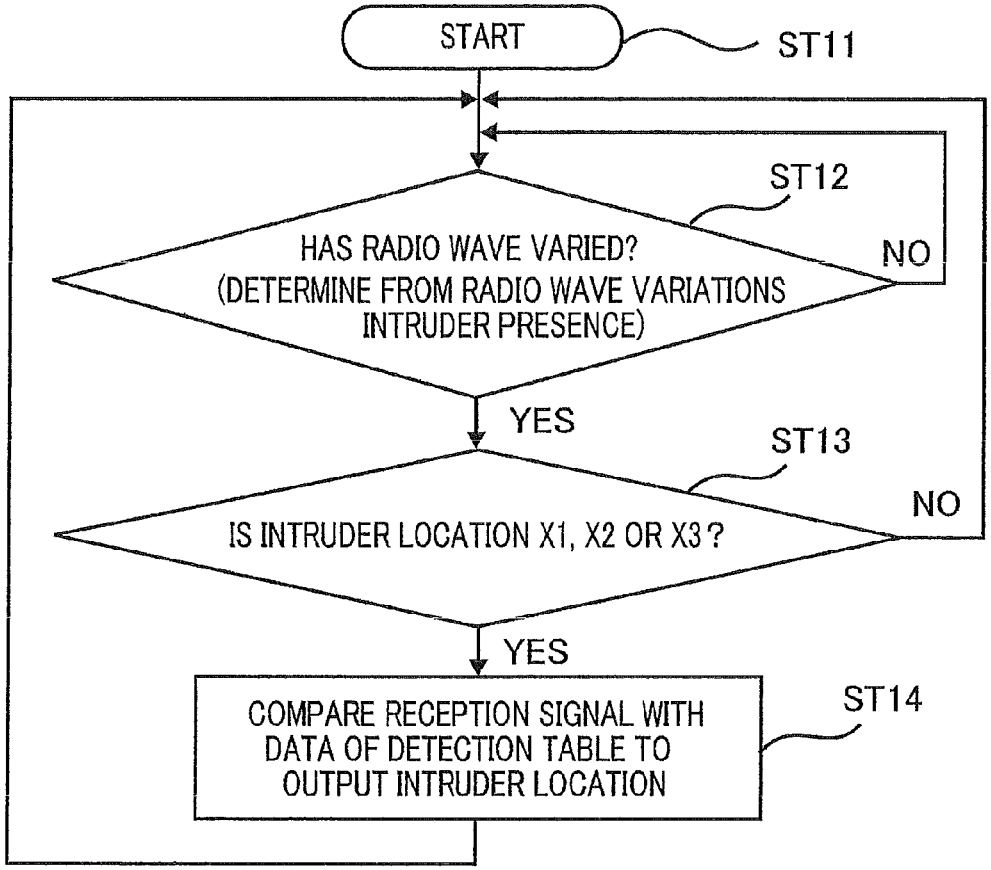
FIG. 6 is a view illustrating an operational flow in the intruder detection device in FIG. 1.

If an intruder intrudes in Step ST11 in FIG. 6 into the space between the leaky transmission line 2-1 and the leaky transmission line 2-2 in FIG. 1 after the system has started its operation, the intruder detection device 1 discriminates in Step ST12 whether or not an electromagnetic wave, namely a detection signal has varied, and then discriminates from the variation in the electromagnetic wave the presence/absence of the intruder. If a variation in the electromagnetic wave is detected (in case an intruder is present) from a determination result in Step ST12 in FIG. 6, the intrusion-location-detection function unit 51 (refer to FIG. 4) determines in Step ST13 which location the intruder has intruded into, X1, X2 or X3.

Next, at Step ST14, if a determination result in Step ST13 (intrusion-location detection information by the intrusion-location-detection function unit 51) is compared with data of the detection table 521 to detect an intruder in a detection area, and it is determined that an intruder is present in the detection area, the detection result output unit 54 outputs the intruder's intrusion location. If an intruder is detected outside a detection area (i.e., in a non-detection area) set in the detection table, the detection result output unit 54 outputs no detection result.

Moreover, when PN codes are used, ranges X1, X2 and X3 are associated with reference spreading codes (e.g., range X1 becomes a range defined by specific reference spreading codes PNX1 (not illustrated) through PNXX (not illustrated)). A received radio wave is phase-computed with specific spreading codes; electric field strength corresponding to the specific spreading codes is computed; when variations in the electric field strength are great, the intrusion is associated with the specific spreading codes, that is, the intrusion is associated with that within the range X1.

According to an intruder detection system as described above, intruder detection can be easily and accurately performed only by matching a detection result with the detection table 521; in addition, detection and non-detection ranges can be set up, setting of those ranges can also be changed, and intruder detection can be performed over a long distance at intervals of every two meters, every five meters and so on. Applications of the intruder detection system can be drastically diversified.

As described above are the basic configuration and operations of the intruder detection system.

By the way, the present invention is characterized in that in the basic intruder detection system described above, at least part of either the transmission-side leaky transmission line or the reception-side leaky transmission line is made of a surface-wave-type leaky coaxial transmission line and the other, a radiation-type leaky coaxial transmission line, in order to set a detection range to a predetermined range and diminish false detection caused by a moving object outside the predetermined range.

Figure 7:
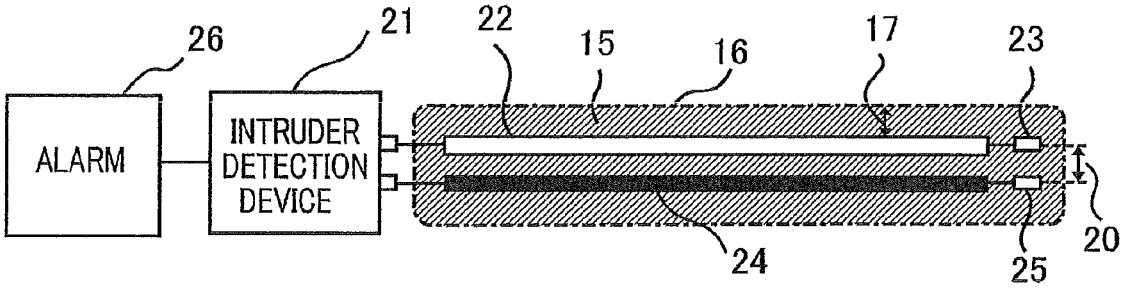
FIG. 7 is a configurational diagram illustrating an outline of an intruder detection system according to Embodiment 1 of the present invention.

FIG. 7 is a configurational view illustrating an intruder detection system according to Embodiment 1 of the present invention, which includes an intruder detection device 21 (corresponding to the intruder detection device 1 in FIG. 1) that radiates and receives a detection signal so as to detect an intruder in order to surveil an intruder surveillance area 15; a surface-wave-type leaky coaxial transmission line 22 connected to the detection signal transmission terminal of the intruder detection device 21; a transmission terminator 23 connected to the far end of the surface-wave-type leaky coaxial transmission line 22; a radiation-type leaky coaxial transmission line 24 for receiving the radiated detection signal, connected to the reception terminal of the intruder detection device 21; a reception terminator 25 connected to the far end of the radiation-type leaky coaxial transmission line 24; and an alarm 26 that informs a guard or the like of the presence/absence of an intruder after the intruder has been detected by the intruder detection system 21.

Next, the operation of Embodiment 1 will be explained referring to FIGS. 7 and 8.

In order to detect an intruder, a detection signal is radiated from the surface-wave-type leaky coaxial transmission line 22 connected to the transmission terminal of the intruder detection device 21; the detection signal is received by the radiation-type leaky coaxial transmission line 24. The received detection signal is inputted into the intruder detection device 21; intruder detection is performed based on this received detection signal. If a person intruded into the space between the surface-wave-type leaky coaxial transmission line 22 and the radiation-type leaky coaxial transmission line 24, a detection signal to be received is reflected or absorbed by his/her body and changes, so that, when compared with a signal taken immediately before the intrusion, the received signal is significantly varied compared to that of no intruder being there. The intruder detection device 21 observes variations in the detection signal caused by the person intruding there.

Next, with reference to this detection signal disturbance, the intruder detection device 21 obtains, using detection signals at several points immediately after the observation, differences among those signals; if difference values exceed a predetermined value, the system determines that an intruder is present there, which is then reported by the alarm 26.

Here, the features of the radiation-type leaky coaxial transmission line 24 and surface-wave-type leaky coaxial transmission line 22 will be presented. Although both transmission lines are intended to radiate a radio wave outside the lines, the radiation-type leaky coaxial transmission line is the one that uses a leaky coaxial transmission cable that propagates a radio wave in leaky wave mode, and radiates a larger quantity of radio wave in a transverse direction (outward direction perpendicular to that along the leaky transmission line), while the surface-wave-type leaky coaxial transmission line is the one that uses a leaky coaxial transmission cable that propagates a radio wave in surface-wave mode (also referred to as open coaxial cable), and generates an electric field only in the close proximity of the line. Therefore, both lines have attenuations of a radiated radio wave differing from each other, with respect to a distance from each line in a transverse direction: in the radiation-type leaky coaxial transmission line, the radio wave varies inversely proportional to a distance therefrom, while, in the surface-wave-type leaky coaxial transmission line, the wave attenuates exponentially proportional to a distance therefrom. Therefore, when a larger quantity of radio wave is radiated in the transverse direction, the radiation-type leaky coaxial transmission line is more advantageous.

In FIG. 7, since the surface-wave-type leaky coaxial transmission line 22 used for transmitting the detection signal has a larger quantity of radiation attenuation in the transverse direction, a distance 17 of an actual detection area 16, from the transmission line 22 can be shortened.

Experiments by the inventor show that there arises a difference between detection ranges, in the transverse direction, of the surface-wave-type leaky coaxial transmission line and the radiation-type leaky coaxial transmission line. This will be explained referring to FIG. 8.

Figure 8:
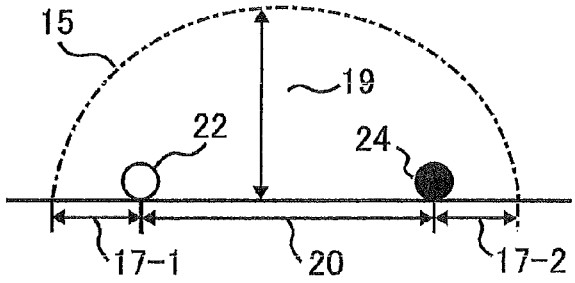
FIG. 8 is a conceptual view for explaining a detection range of the intruder detection system according to Embodiment 1.

FIG. 8 illustrates the surface-wave-type leaky coaxial transmission line 22 that radiates a detection signal, the radiation-type leaky coaxial transmission line 24 that receives the detection signal, an intruder surveillance area 15, and a detection height 19; a detection range 17-1 in the transverse direction of the surface-wave-type leaky coaxial transmission line 22 becomes narrower than a detection range 17-2 in the transverse direction of the radiation-type leaky coaxial transmission line 24. For this reason, provision of a surface-wave-type leaky coaxial transmission line on a side in which its detection area needs to be particularly narrowed enables unnecessary detection to be avoided.

Figure 9:
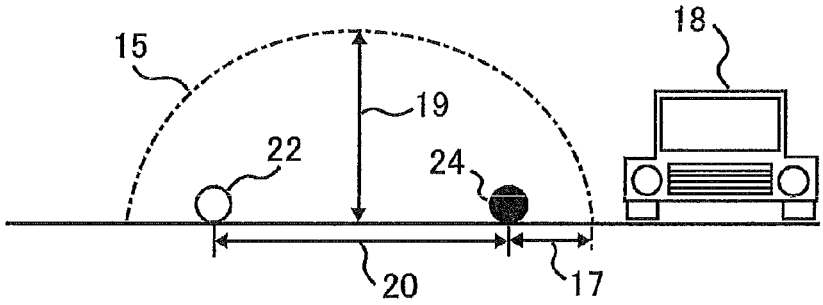
FIG. 9 is a conceptual view for explaining another detection range of the intruder detection system according to Embodiment 1.

Therefore, by configuring as shown in FIG. 7 it can be ensured that the actual detection area 16 is the same as the intruder surveillance area 15, so that a highly reliable intruder detection system from a detection viewpoint can be obtained. Thereby, it becomes possible to eliminate false detection caused by a moving object 18 outside a requested detection range as shown in FIG. 9. Moreover, by using the radiation-type leaky coaxial transmission line 24 for the line that receives a detection signal, a distance 20 spacing transmission and reception lines apart form each other can be extended, so that the detectable height 19 can also be increased.

In addition, the same effect can be brought about even if the transmission and reception lines are reversed in such a way that the transmission-side transmission line is made of a radiation-type leaky coaxial transmission line and the reception-side transmission line, a surface-wave-type coaxial transmission line.

Embodiment 2

Figure 10:
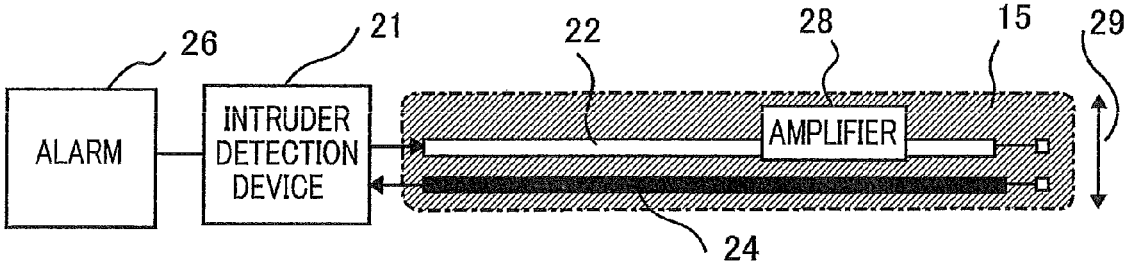
FIG. 10 is a configurational view illustrating an outline of an intruder detection system according to Embodiment 2 of the present invention.

FIG. 10 is a configurational view illustrating an intruder detection system according to Embodiment 2 of the present invention. In FIG. 10, blocks with the same reference numerals as those in FIG. 7 have the same functions as have been explained in Embodiment 1.

The intruder detection system illustrated in FIG. 10 is characterized in that an amplifier 28 that amplifies a detection signal under transmission is provided halfway through the surface-wave-type leaky coaxial transmission line 22 that constitutes the transmission-side leaky transmission line. The detection signal is attenuated depending on its transmission distance along the leaky transmission line; when the detection signal level becomes lower than a predetermined value, intruder detection can not be properly performed. The amplifier 28 is inserted, as illustrated in FIG. 10, halfway through the transmission-side leaky transmission line 22 so as to amplify the detection signal before it becomes lower than the predetermined value.

This amplifier 28 is inserted halfway through only the transmission-side leaky transmission line but not the radiation-side leaky transmission line, the reason for which is that the amplifier can amplify a signal but at the same time the amplifier adds noise to the signal. If it is inserted on the reception side, quality of the reception signal (signal to noise ratio) will be deteriorated. Insertion of the amplifier on the reception side therefore adversely affects overall detection capability, causing a problem since the detection area is narrowed. Since the signal level of a transmission signal is originally high, noise generated in the amplifier 28 can be ignored; therefore, when the amplifier is added on the transmission side, problems such as detection capability deteriorating do not arise.

Following the above discussion, the amplifier 28 is inserted halfway through the surface-wave-type leaky coaxial transmission line 22 that constitutes the transmission-side leaky transmission line so as to amplify the detection signal before it becomes lower than the predetermined level; thereby, intruder detection can be properly performed over a long distance along the line.

Figure 11:
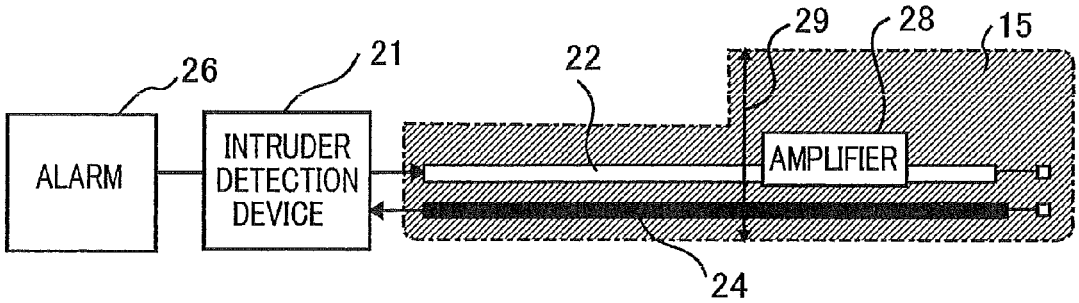
FIG. 11 is a configurational view illustrating another example of the intruder detection system according to Embodiment 2.
Figure 12:
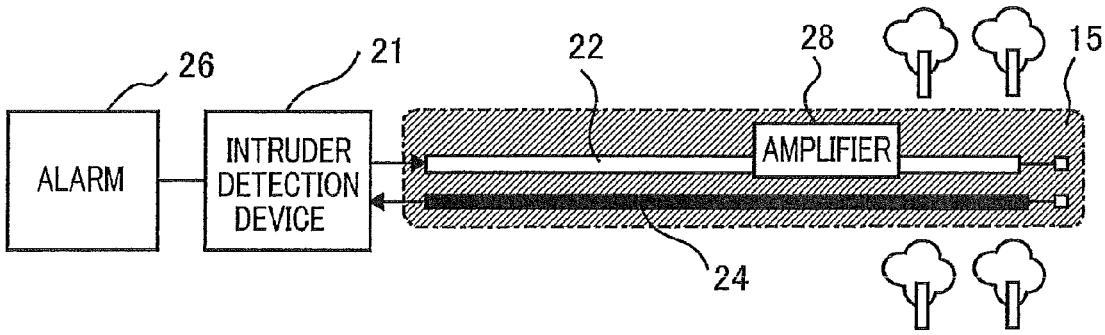
FIG. 12 is a configurational view illustrating still another example of the intruder detection system according to Embodiment 2.

By the way, it is sometimes needed to partially extend an intruder detection range 29 that is a detection range in a direction perpendicular to the leaky transmission lines. In a case such as this, if the amplifier 28 is inserted as illustrated in FIG. 11, the intruder detection range 29 can be partially extended. Meanwhile, if the intruder detection range 29 needs to be narrowed, an attenuator may be inserted instead. Moreover, the intruder detection range sometimes becomes narrow depending on the ambient environment. For example, when the leaky transmission lines are buried in the ground, those lines may sometimes pass through bushes and woods. By inserting in those cases the amplifier 28 as illustrated in FIG. 12, the intruder detection range 29 can be extended.

As described above, the system according to Embodiment 2 is configured in such a way that the amplifier 28 is inserted halfway through the surface-wave-type leaky coaxial transmission line 22 that constitutes the transmission-side leaky transmission line, which therefore brings about an effect in that accurate intruder detection can be performed over a long distance.

Embodiment 3

Figure 13:
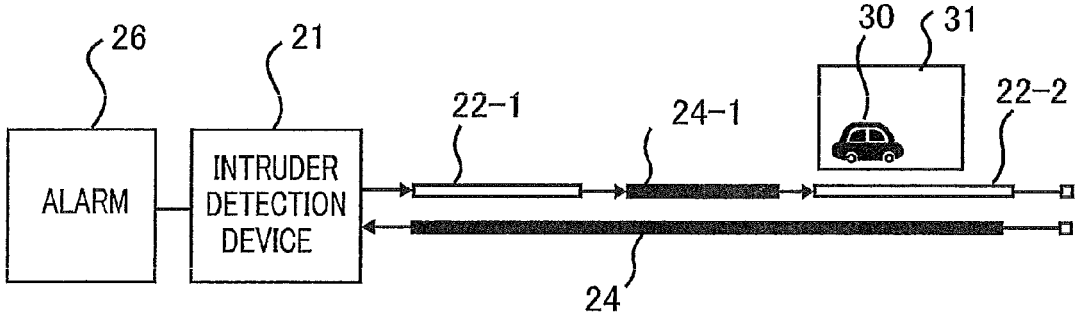
FIG. 13 is a configurational view illustrating an outline of an intruder detection system according to Embodiment 3 of the present invention.

FIG. 13 is a configurational view of an intruder detection system according to Embodiment 3.

The intruder detection system illustrated in FIG. 13 is characterized in that portions of the transmission-side leaky transmission line (both end portions in the figure) are made of the surface-wave-type leaky coaxial transmission line 22-1 and 22-2, and the remaining portion thereof (middle portion in the figure), the radiation-type leaky coaxial transmission line 24-1.

In FIG. 13, a detection signal radiated from the leaky transmission line is disturbed as being reflected and absorbed; therefore, the detection signal is likely to be disturbed in an area where a parking lot 31 or the like exists nearby. If the detection signal is disturbed under the influence of a vehicle 30 or the like, it will be greatly scattered, which will resultantly make proper detection impossible. In particular, if the transmission-side leaky transmission line is made of a radiation-type leaky coaxial transmission line, a large quantity of detection signal is radiated, thereby resulting in a large quantity of signal being scattered. In order to diminish the signal scattering in the vicinity of the parking lot 31, under the influence of the vehicle 30 or the like, the surface-wave-type leaky coaxial transmission lines 22-1 and 22-2 are provided as illustrated in FIG. 13 at portions of the transmission-side leaky transmission line. The quantity of detection signal radiated from the surface-wave-type leaky coaxial transmission lines becomes less, so that disturbance in the detection signal due to the vehicle 30 or the like can be lessened.

From the above description, more accurate detection is enabled by configuring portions of the transmission-side leaky transmission line using the surface-wave-type leaky coaxial transmission line 22-1 and 22-2.

Figure 14:
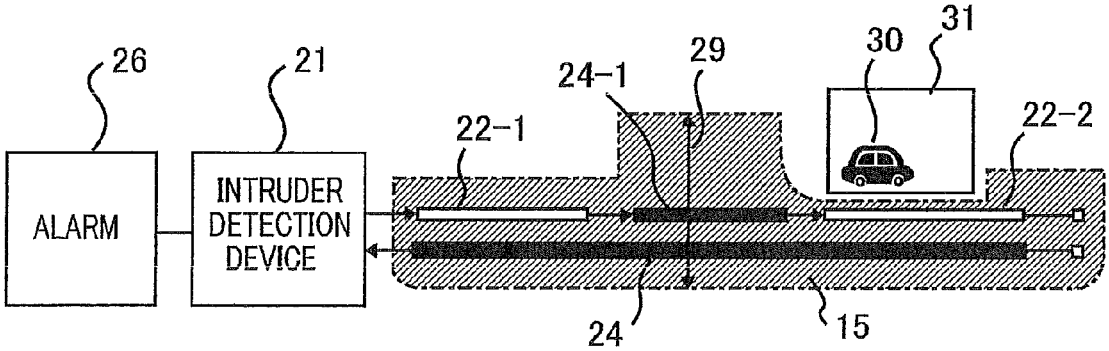
FIG. 14 is a configurational view illustrating another example of the intruder detection system according to Embodiment 3.

By the way, the intruder detection range 29 that is a detection range in a direction perpendicular to the leaky transmission line sometimes needs to be partially extended. As illustrated in FIG. 14, by inserting in those cases the radiation-type leaky coaxial transmission line 24-1, in a portion of the transmission-side leaky transmission line, the intruder detection range 29 can be extended. Moreover, this configuration can be combined with that of Embodiment 2; the intruder surveillance area 15 can also be properly extended by adding the amplifier 28 as illustrated in Embodiment 2. Meanwhile, if the intruder detection range 29 needs to be narrowed, an attenuator may be inserted instead.

Thereby, in Embodiment 3, provision of configurations as in FIG. 13 and FIG. 14 brings about an effect in that accurate intruder detection can be performed even if there is an object that disturbs the detection signal.

Embodiment 4

Figure 15:
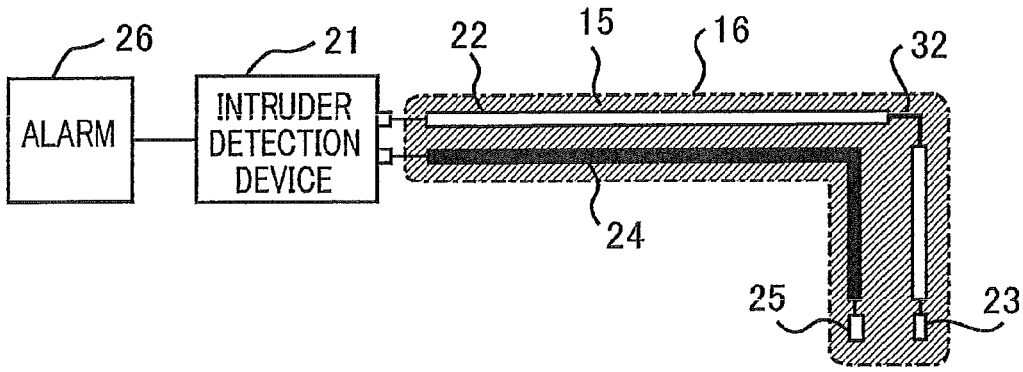
FIG. 15 is a configurational view illustrating an outline of an intruder detection system according to Embodiment 4 of the present invention.

FIG. 15 is a configurational view of an intruder detection system according to Embodiment 4.

The intruder detection system illustrated in FIG. 15 is characterized in that a coaxial transmission line that does not radiate a radio wave into the air is provided at a predetermined portion along the surface-wave-type leaky coaxial transmission line that constitutes the transmission-side leaky transmission line; a coaxial transmission line 32 is used for a bent portion of the transmission-side leaky transmission line, so that non-rectilinear transmission lines for transmitting and receiving a detection signal as well as an intruder detection area associated with those lines can be secured. The coaxial transmission line 32 has characteristics different from those of the surface-wave-type leaky coaxial transmission line and the radiation-type leaky coaxial transmission line, and radiates no radio wave into the air.

Figure 16:
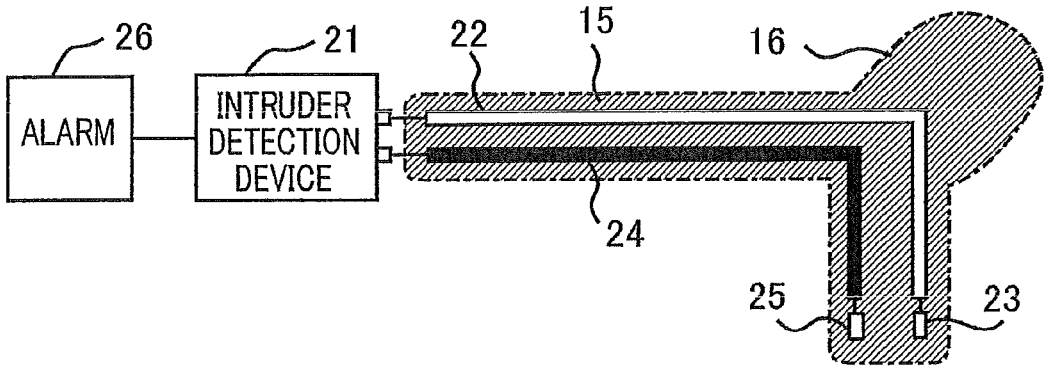
FIG. 16 is a configurational view for explaining the intruder detection system according to Embodiment 4.

If a surface-wave-type leaky coaxial transmission line is bent, the shape of the outer conductor thereof that determines its radiation characteristics is deformed so that the transmission line demonstrates radiation characteristics similar to those of a radiation-type leaky coaxial transmission line. Therefore, if the surface-wave-type leaky coaxial transmission line 22 is bent as illustrated in FIG. 16, the actual intruder detection area 16 at the bent portion becomes wider than the intruder surveillance area 15, which resultantly causes this area to become a false-alarm occurring area.

As with Embodiment 4, using of the coaxial transmission line 32 for the bent portion of the surface-wave-type leaky coaxial transmission line 22 that constitutes the transmission-side leaky transmission line enables not only the false-alarm occurring area to be eliminated but also a non-rectilinear surface-wave-type leaky coaxial transmission line as well as an intruder surveillance area associated therewith to be secured.

Embodiment 5

Figure 17:
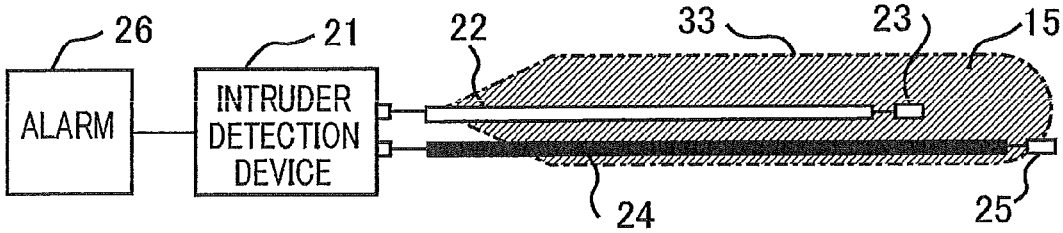
FIG. 17 is a configurational view illustrating an outline of an intruder detection system according to Embodiment 5 of the present invention.

FIG. 17 is a configurational view of an intruder detection system according to Embodiment 5.

The intruder detection system illustrated in FIG. 17 is characterized in that the terminator 25 of the reception-side leaky transmission line is located, from the intruder detection device, farther than the terminator 23 of the transmission-side leaky transmission line.

As illustrated in FIG. 17, a longitudinal radiation characteristic 33, along the line, of the surface-wave-type leaky coaxial transmission line 22 that constitutes the transmission-side leaky transmission line is such that a larger quantity of radio wave is radiated in the direction toward the terminator 23 of the transmission-side leaky transmission line. Therefore, when a transmission line that has the radiation characteristics described above is used as the transmission-side transmission line for the detection signal, by locating the terminator 25 of the reception-side leaky transmission line farther than the terminator 23 of the transmission-side leaky transmission line, a larger quantity of detection signal can be received, so that an intruder surveillance area can be efficiently secured.

Various modifications and alterations of this invention will be apparent to those skilled in the art without departing from the scope and spirit of this invention, and it should be understood that this is not limited to the illustrative embodiments set forth herein.

What is claimed is:

1. An intruder detection system, comprising:

a transmission-side leaky transmission line for transmitting a detection signal for detecting an intruder; and a reception-side leaky transmission line for receiving a detection signal leaked from the transmission-side leaky transmission line;

the transmission-side leaky transmission line and the reception-side leaky transmission line being buried spaced apart from each other in an intruder surveillance area, and the presence/absence of an intruder being detected based on a variation in the detection signal received by the reception-side leaky transmission line; wherein at least part of one of the transmission-side leaky transmission line or the reception-side leaky transmission line is made of a surface-wave-type leaky coaxial transmission line, and the other one of the transmission-side leaky transmission line or the reception-side leaky transmission line is made of a radiation-type leaky coaxial transmission line.

2. An intruder detection system according to claim 1, wherein an amplifier for amplifying a detection signal under transmission is provided halfway through the surface-wave-type leaky coaxial transmission line constituting the transmission-side leaky transmission line.

3. An intruder detection system according to claim 1, wherein part of the transmission-side leaky transmission line is made of a surface-wave-type leaky coaxial transmission line and the remaining part thereof, a radiation-type leaky coaxial transmission line.

4. An intruder detection system according to claim 1, wherein a coaxial transmission line that does not radiate a radio wave into the air is provided at a predetermined portion of the surface-wave-type leaky coaxial transmission line constituting the transmission-side leaky transmission line.

5. An intruder detection system according to claim 1, further comprising an intruder detection device, wherein a terminator of the reception-side leaky transmission line is located farther from the intruder detection device than that of the transmission-side leaky transmission line.

6. An intruder detection system according to claim 1, further comprising an intruder detection unit including an intrusion-location-detection function unit for detecting an intrusion location of the intruder based on a variation in the detection signal received by the reception-side leaky transmission line, so as to output intrusion-location detection information; a detection table for associating a detectable intrusion location with a detection area; and a detection result output unit for outputting a detection result when the intrusion-location detection information is associated with a detection area in the detection table.

* * * * *